US008678705B1

(12) United States Patent
Smith et al.

(10) Patent No.: US 8,678,705 B1
(45) Date of Patent: Mar. 25, 2014

(54) CHANNEL FLEX REVETMENT BLOCK AND CABLED MAT

(75) Inventors: Lee A. Smith, Houston, TX (US); James R. DeShaw, Huntsville, TX (US)

(73) Assignee: Erosion Prevention Products, LLC, South Houston, TX (US)

( * ) Notice: Subject to any disclaimer, the term of this patent is extended or adjusted under 35 U.S.C. 154(b) by 62 days.

(21) Appl. No.: 13/458,176

(22) Filed: Apr. 27, 2012

Related U.S. Application Data

(60) Provisional application No. 61/518,060, filed on Apr. 29, 2011.

(51) Int. Cl.
*E02B 3/14* (2006.01)

(52) U.S. Cl.
USPC ..... 405/20; 405/16

(58) Field of Classification Search
USPC ..... 405/15, 16, 17, 19, 20, 302.4, 302.6
See application file for complete search history.

(56) References Cited

U.S. PATENT DOCUMENTS

| | | | | | |
|---|---|---|---|---|---|
| 1,164,708 | A | * | 12/1915 | Edinger | 405/20 |
| 2,674,856 | A | * | 4/1954 | Louckes | 405/20 |
| 4,227,829 | A | | 10/1980 | Landry, Jr. | |
| 4,370,075 | A | | 1/1983 | Scales | |
| 4,499,664 | A | | 2/1985 | Scales | |
| 4,564,311 | A | * | 1/1986 | Scales | 405/20 |
| 4,664,552 | A | | 5/1987 | Schaaf | |
| 4,683,156 | A | | 7/1987 | Waters | |
| 4,773,790 | A | | 9/1988 | Hagenah | |
| 4,875,803 | A | * | 10/1989 | Scales | 405/16 |
| 5,020,938 | A | | 6/1991 | Scales | |
| 5,484,230 | A | | 1/1996 | Rudloff | |
| 5,556,228 | A | | 9/1996 | Smith | |
| 5,775,838 | A | * | 7/1998 | Pettee, Sr. | 405/20 |
| 5,779,391 | A | | 7/1998 | Knight | |
| 5,846,023 | A | * | 12/1998 | Angel et al. | 405/17 |
| 5,906,456 | A | | 5/1999 | Knight | |
| 5,921,710 | A | * | 7/1999 | Scales | 405/20 |
| 6,071,041 | A | | 6/2000 | Knight | |
| 6,079,902 | A | * | 6/2000 | Pettee, Jr. | 405/20 |
| 6,276,870 | B1 | | 8/2001 | Smith | |
| 6,508,607 | B1 | | 1/2003 | Smith | |
| 6,579,038 | B1 | * | 6/2003 | McAllister et al. | 405/16 |
| 6,866,446 | B2 | * | 3/2005 | McAllister et al. | 405/16 |
| 6,955,500 | B1 | | 10/2005 | Smith | |
| 7,037,037 | B1 | | 5/2006 | Smith et al. | |
| 7,717,644 | B2 | * | 5/2010 | Han | 405/16 |
| 8,123,434 | B1 | | 2/2012 | Smith | |
| 8,123,435 | B1 | | 2/2012 | DeShaw et al. | |
| 2008/0089743 | A1 | * | 4/2008 | Han | 405/18 |

* cited by examiner

*Primary Examiner* — Frederick L Lagman
(74) *Attorney, Agent, or Firm* — Roger N. Chauza, P.C.

(57) ABSTRACT

An erosion control block having registration ribs and slots on opposite edge surfaces to align neighbor blocks together in a cabled mat of blocks. The blocks have a pair of parallel cable channels therethrough, as well as a single orthogonal cable channel formed therethrough. With this arrangement, the blocks are versatile and can be configured in a mat of side-by-side blocks, or in a mat of staggered blocks. Neighbor mats can be easily fastened together. The parallel cable channels are formed through the block at a location adjacent an articulation edge so that when a mat of cabled blocks are lifted in a catenary, the articulation between blocks is facilitated.

20 Claims, 4 Drawing Sheets

CHANNEL FLEX REVETMENT BLOCK AND CABLED MAT

RELATED APPLICATION

This non-provisional U.S. patent application claims the benefit of pending U.S. provisional patent application filed Apr. 29, 2011, application No. 61/518,060.

TECHNICAL FIELD

The present invention relates in general to revetment blocks, and more particularly to blocks of the type that are adapted for being cabled together in different mat configurations.

BACKGROUND OF THE INVENTION

Revetment blocks are well known for preventing or controlling erosion in areas that carry runoff water. The blocks can be manually installed as a mat in the watershed areas, or installed as cabled mats in the areas to control the flow of water. The cabling of a mat of erosion control blocks is carried out by laying a mat of blocks on the ground or other suitable surface and extending cables through the cable channels of the blocks to effectively cable the entire group of blocks together as a unit. The unit or mat of blocks is then lifted by a crane via the cables and laid onto the watershed area to be protected from erosion. The installation of the cabled mat of erosion control blocks is advantageous where the area to be protected is covered with water. Once each cabled mat is lowered and installed in place, divers can be employed in deep water areas to attach the edges of the mats of blocks together to provide an overall integrity to the entire system of mats.

Erosion control blocks are available in many different designs, each to satisfy a particular need. When a large watershed area is to be protected by large mats of erosion control blocks, the project is usually placed up for bid to allow competitors to compete for the job according to stated specifications. The bid includes a number of specifications for the individual blocks as well as the arrangement when cabled together. Some bids require that the mat of blocks be cabled together in only one direction, and not in the orthogonal direction of the mat. Other bid specifications require that the mat of blocks be cabled together in both orthogonal directions. Yet other bid specifications require the erosion control blocks to be aligned together in a mat side-by-side in both rows and columns, such as shown in U.S. Pat. No. 5,484,230 by Rudloff. Other bid specifications require the erosion control blocks to be staggered in one direction, such as depicted in U.S. Pat. No. 4,370,075 by Scales.

Because of the individual design features of many erosion control blocks, a single type of block cannot often satisfy all of the bid specifications of different jobs or projects. A certain type of block can satisfy some job specifications, and other types of blocks can satisfy other job specifications. Thus, it has heretofore been difficult to achieve a block design that could satisfy many different job specifications and thus have universal applications in many different projects.

From the foregoing, a need exists for a revetment block that can be configured in either a mat of side-by-side blocks, or in a mat of staggered blocks. Another need exists for a revetment block that is registered in rows using guide ribs and guide slots, irrespective of whether the blocks are configured in the side-by-side arrangement or the staggered arrangement. Yet another need exists for a block where the cable exits one block and enters the neighbor block at a location adjacent a point or edge of articulation between the blocks to thereby facilitate articulation when suspended in a catenary.

SUMMARY OF THE INVENTION

Disclosed is a revetment block having a construction that allows it to be configured in a mat as side-by-side blocks cabled together, or as staggered blocks. The revetment block of the invention includes registration means between neighbor blocks of a cabled mat to maintain the blocks of a row registered together. The registration means can include a pair of guide ribs on one vertical side of the block and a pair of guide slots on the opposite vertical side of the block.

In accordance with another feature of the invention, the revetment block includes a pair of parallel cable channels formed therethrough. A cable can be threaded through the parallel cable channels between neighbor blocks in either a side-by-side row of blocks of a mat, or staggered rows of blocks of a mat. The guide ribs and guide slots are effective to maintain registration of rows of blocks in both mat configurations.

According to yet another feature, the parallel pair of cable channels are formed at a location through the revetment block where neighbor blocks articulate with respect to each other when suspended as a mat in a catenary. There is thus less stress on the cable as it exits the cable channel of one block and enters the cable channel of the neighbor block.

According to one embodiment of the invention, disclosed is a revetment block adapted for being cabled to one or more neighbor revetment blocks of similar construction. The revetment block includes a body constructed of a heavy material, a pair of cable channels extended through the body of the revetment block, two spaced-apart guide slots formed in one side surface of the body of the revetment block, and two spaced-apart guide ribs formed in an opposite side surface of the revetment block. The two guide ribs of the revetment block are adapted for being engaged in two respective guide slots of one neighbor revetment block when configured in a side-by-side arrangement of revetment blocks of a first type mat, and the pair of cable channels of the revetment block are aligned with the respective cable channels of the neighbor revetment block to form the first type mat. In a staggered configuration, one guide rib of the revetment block is adapted for being engaged in a guide slot of one neighbor revetment block and the other guide rib of the revetment block is adapted for being engaged in a guide slot of another neighbor revetment block of a second type mat, and a first cable channel of the pair of cable channels of the revetment block is aligned with one cable channel of the one neighbor revetment block and a second cable channel of the pair of cable channels of the revetment block is aligned with one cable channel of another neighbor revetment block to form a second type mat.

According to another embodiment of the invention, disclosed is a revetment block adapted for being cabled to one or more neighbor revetment blocks of similar construction, where the revetment block includes a body constructed with a heavy material, a top beveled portion and a bottom rectangular portion. Further included is one or more vegetation holes extending from a top surface of the revetment block to a bottom surface of the revetment block. A pair of parallel cable channels extend through the bottom rectangular portion of the revetment block, but the pair of parallel cable channels do not extend through the vegetation holes. A third cable channel extends through the bottom rectangular portion of the revetment block between the pair of vegetation holes, but does not extend through the vegetation holes. Two spaced-apart guide slots are formed in one vertical side surface of the bottom rectangular portion of the revetment block. Two spaced-apart guide ribs are formed in an opposite vertical side surface of the bottom rectangular portion of the revetment block. The guide ribs of the revetment block are adapted for being engaged in respective guide slots of one neighbor revetment block when configured in a side-by-side arrangement of revetment blocks of a first type mat. One guide rib of the revetment block is adapted for being engaged in a guide slot of one neighbor revetment block and the other guide rib of the revetment block is adapted for being engaged in a guide slot of another neighbor revetment block when configured in a staggered arrangement of revetment blocks of a second type mat.

According to yet a further embodiment of the invention, disclosed is a revetment block adapted for being cabled to one or more neighbor revetment blocks of similar construction, where the revetment block includes a body constructed of a heavy material, and the body has a top beveled portion and a bottom portion. A pair of cable channels extend through the body of the revetment block. Two spaced-apart guide slots are formed in one side surface of the bottom portion of the revetment block, and two spaced-apart guide ribs are formed in an opposite side surface of the bottom portion of the revetment block. The pair of cable channels are spaced apart the same distance as the guide slots are spaced apart, and the pair of guide ribs are spaced apart the same distance as the guide slots are spaced apar. The top beveled portion of the revetment block joins the bottom portion at an edge of articulation so that a neighbor revetment block articulates with respect to the revetment block about the edge of articulation. The pair of cable channels have respective openings in a surface of the body of the revetment block, and an edge of each cable channel opening is adjacent the edge of articulation.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
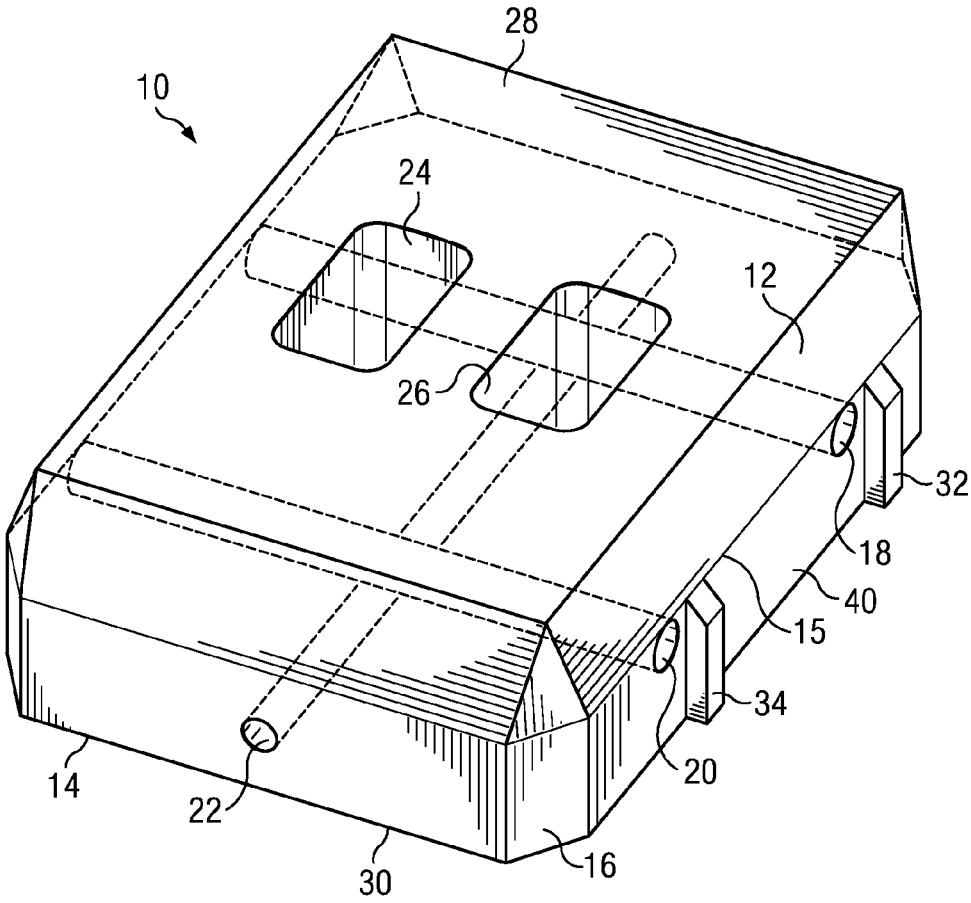
FIG. 1 is an isometric top view of the erosion control block according to an embodiment of the invention.

FIG. 1 illustrates an embodiment of an erosion control block constructed according to the invention. The block 10 is molded using a concrete material, or other suitable material, to form a heavy block. The molded block 10 includes a beveled top 12 to allow a certain degree of articulation when a mat of blocks is suspended with cables. It can be appreciated that the suspended mat of cabled blocks 10 is bowed to form a catenary when lifted by a crane. All four top angled surfaces 12 are beveled inwardly toward the top of the block 10. The bottom base portion 14 of the block 10 is generally rectangular shaped, but has four angled corners, one shown as numeral 16. As used herein, the term "rectangle" or "rectangular" includes a square. According to one embodiment, the length of the block 10 is about sixteen inches, and the width of the block 10 is about thirteen inches. The overall thickness of the block 10 is about six inches, with the beveled top 12 about two and one-half inches high and the rectangular bottom 14 about three and one-half inches in height. The block 10 can be formed with many other dimensions, shapes and sizes.

The block 10 is formed with a pair of parallel cable channels 18 and 20 that extend laterally through the width of the block 10. The top of the each cable channel is located in the interface plane 15 between the top beveled portion 12 and the bottom rectangular part 14 of the block 10. The two parallel cable channels 18 and 20 are formed through the rectangular bottom 14 of the block 10 between the opposite sides of the width of the block 10. A single cable channel 22 is formed through the rectangular bottom 14 of the block 10 between the opposite ends of the length of the block 10. The cable channels 18, 20 and 22 are all about one inch in diameter.

When a mat of the blocks 10 are cabled together, the cables that extend through the parallel cable channels 18 and 20 are suspended between spreader bars lifted by a crane, or the like. When lifted, the cabled mat of blocks 10 forms a catenary so that the blocks bow downwardly from one end of the mat to the other end. As such, each block must flex or articulate at the juncture 15 between each block, which is generally at the plane between the top beveled portion 12 of the block 10 and the bottom rectangular base 14 of the block 10. The point of articulation between adjacent blocks in a bowed mat of blocks 10 is thus about the lateral edge 15, where the vertical side joins to the beveled surface of the top portion 12. A similar lateral edge of articulation exists on the opposite side of the block 10.

Figure 3:
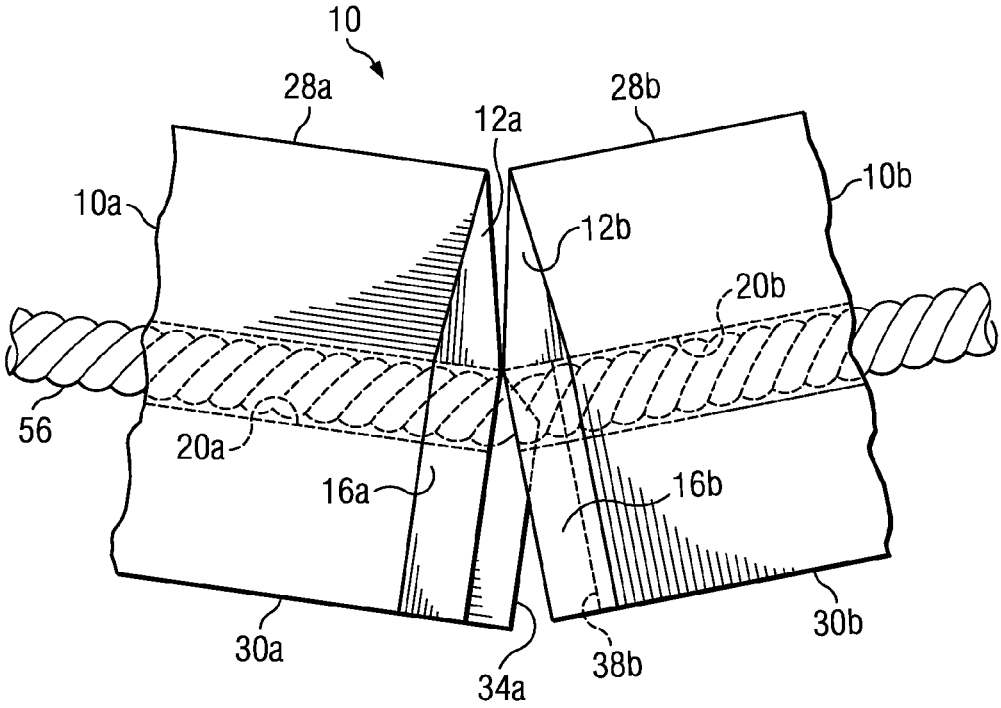
FIG. 3 is a side view of portions of neighbor blocks that are articulated adjacent an edge in which a cable passes through the neighbor blocks.

The articulation of blocks 10 in a cabled mat is facilitated by forming the cable channels as close to the edge of articulation as convenient. The cable channels 18 and 20 are formed at or just above or below the edge 15 of articulation. In the preferred embodiment, the cable channels 18 and 20 are formed just below the edge 15 of articulation in the bottom portion 14 of the body of the revetment block 10. As the blocks articulate, the bottom surfaces of the blocks 10 separate from each other somewhat to form the catenary, and the edges 15 of articulation between neighbor blocks 10 are compressed together. This is shown in FIG. 3. The cables 56 extending through the cable channels 18 and 20 also bend somewhat at the edge of articulation 15. With this arrangement, there is little or no axial movement of the cables with respect to the blocks 10, thus reducing friction between the cables 56 and the blocks 10, thus facilitating the lifting of a mat of cabled blocks 10. In addition, with no relative axial movement of cables 56 within the cable channels 18 and 20, there is less likelihood of wear or breakage of the cable strands as the cables exit and enter the cable channels of neighbor blocks of the catenary.

Figure 4:
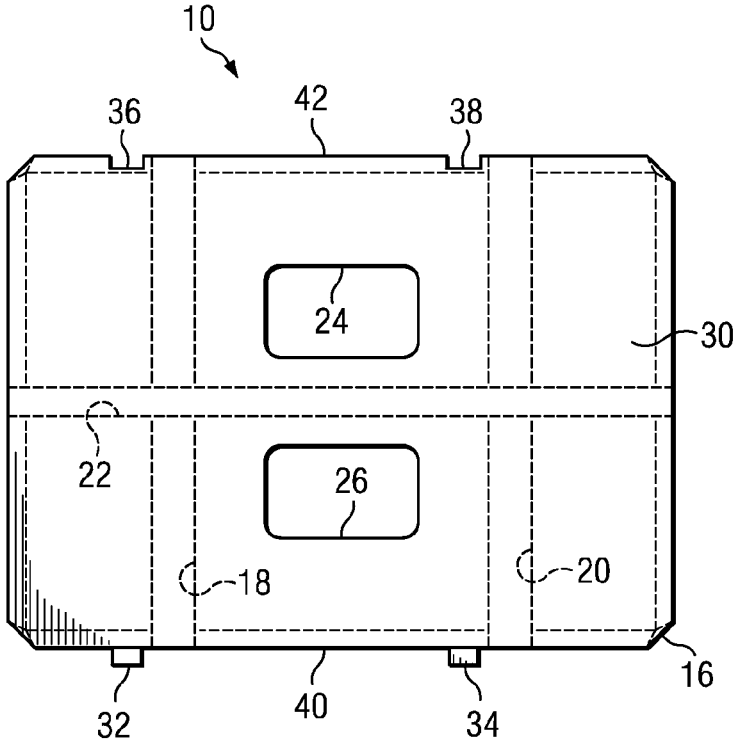
FIG. 4 is a bottom view of the block showing the cable channels, the two guide slots and the two guide ribs.

A pair of vegetation holes 24 and 26 are formed vertically through the body of the block 10, from the top surface 28 to the bottom surface 30 of the block 10. The third cable channel 22 extends through the length of the block 10 between the vegetation holes 24 and 26, and under the pair of parallel channels 18 and 20. The parallel cable channels 18 and 20 are formed laterally through the block 10 on each side of the vegetation holes 24 and 26, as shown in FIG. 4. The openings of the vegetation holes 24 and 26 are about two and one-half inches by about four and one-half inches and are located symmetrically within the top 28 and bottom 30 surfaces of the block 10.

Figure 2:
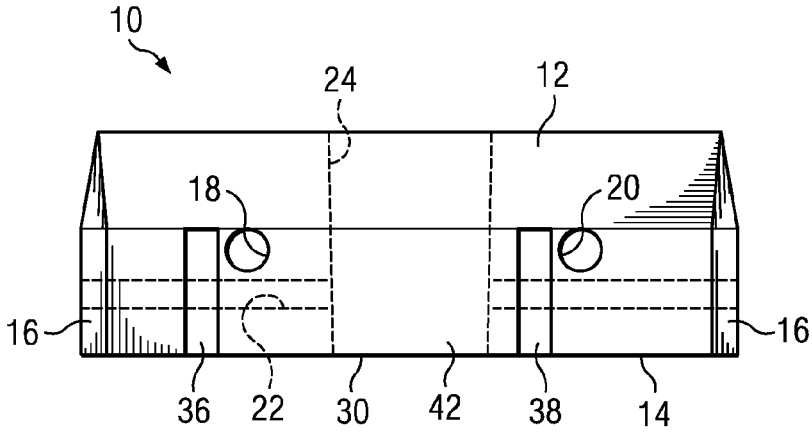
FIG. 2 is a side view of the block showing the two vertical guide slots.

As noted above, the top of each of the parallel cable channels 18 and 20 is located at the interface plane 15 between the beveled top 12 and the rectangular bottom 14 of the block 10. This is shown in FIGS. 1-3. The third cable channel 22 is located at an elevation below the parallel cable channels 18 and 20. In practice, the vertical distance between the center lines of the cable channels 18 and 20, and the underlying cable channel 22, is about 1.5 inches.

Formed adjacent to the parallel cable channels 18 and 20, laterally offset therefrom, and on one side surface of the rectangular bottom 14, are respective guide ribs 32 and 34. The guide ribs 32 and 34 extend outwardly from the side surface 40 of the block 10 (FIG. 1). When facing the revetment block 10 from the side on which the guide ribs are visible, the guide rib 32 is offset to the right of the cable opening 18, and the other guide rib 34 is similarly offset to the right of the cable opening 20. The guide ribs 32 and 34 each extend from the bottom surface of the block 10 upwardly along the bottom base portion 14, and stop at the interface edge 15 between the bottom portion 14 and the beveled top portion 12. The top surfaces of both of the guide ribs 32 and 34 are slanted in the same plane as the slanted top 12. The guide ribs 32 and 34 are each formed with a size of about two and one-half inch high, a width of one-half inch, and a depth of about one-quarter inch.

On the opposite side surface 42 of the rectangular bottom 14 portion of the block 10, and adjacent to the cable channels 18 and 20, are formed respective guide slots 36 and 38 (FIGS. 2 and 4). When facing the revetment block 10 from the side on which the guide slots are visible, the guide slot 36 is offset to the left of the cable opening 18, and the other guide slot 38 is similarly offset to the left of the cable opening 20. The guide ribs 32 and 34 of one block 10 are constructed to engage within the respective guide slots 36 and 38 of one or two neighbor blocks 10, depending on whether the neighbor blocks are arranged side by side or staggered. The guide slots 36 and 38 are each formed about two and one-half inches high, a width of about one inch, and a depth of about one-fourth inch. With these dimensions, there is some degree of lateral slideable action of a one-half inch wide guide rib of one block within the one inch wide guide slot of a neighbor block. The guide slots 36 and 38 extend from the bottom surface of the block 10 and vertically upwardly until they open in the beveled surface of the top 12. Thus, one block 10*a* can be lowered with respect to a neighbor block 10*b* during formation of the mat, so that the guide ribs 32 and 34 of the one block 10*a* can be lowered in the guide slots of the neighbor block 10*b* to an elevation where the cable channels are aligned between the blocks (FIG. 5).

The bottom view of the block 10 in FIG. 4 clearly illustrates the alignment of the cable channels 18 and 20 with the guide ribs 32 and 34 on one side 40 of the block 10, and with the guide slots 36 and 38 formed on the other side 42 of the block 10. In addition to lateral slideable movement between neighbor blocks via the mating guide ribs and guide slots, the neighbor blocks also have a degree of vertical movement therebetween via the mated guide ribs and guide slots. As also shown in FIG. 4, the two parallel cable channels 18 and 20 straddle the vegetation holes 24 and 26, while the third cable channel 22 is located between the vegetation holes 24 and 26.

In accordance with an important feature of the invention, the revetment block 10 can be cabled in different mat configurations, namely, a side-by-side configuration or a staggered configuration. The ability of the erosion control block 10 to satisfy both conditions is important when compliance with different specifications is required. In practice, some specifications for mats require that the blocks of a mat be configured in a side-by-side arrangement. Other specifications require the blocks of a mat be configured in a staggered or offset arrangement. The prior art disclosed various blocks that can comply with some specifications, but not other specifications. Thus, different blocks are generally required in order to satisfy both specifications. The block 10 of the invention can satisfy both specifications, and thus is versatile and cost effective as only a single type of block is needed to comply with both specifications.

Figure 5:
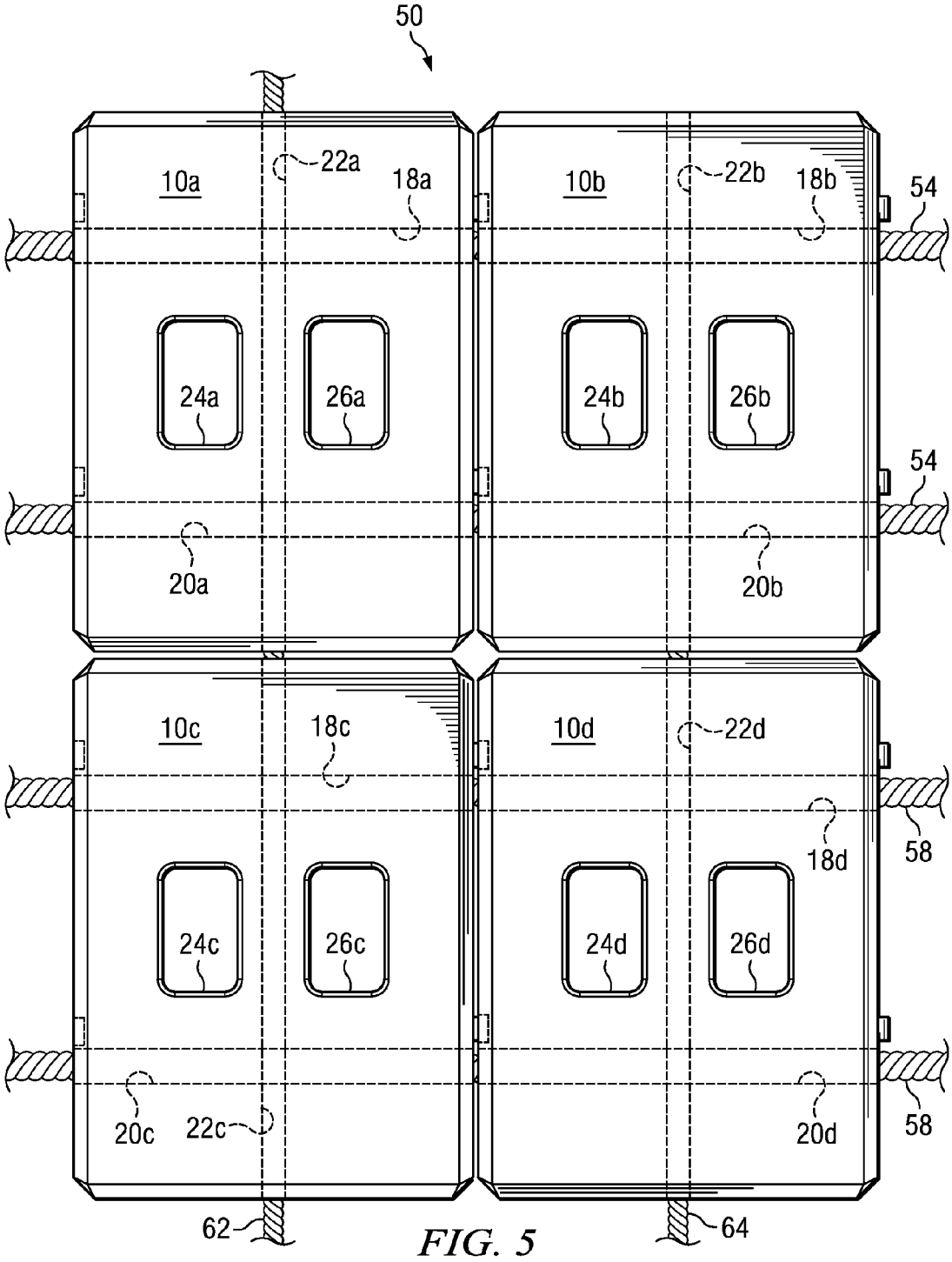
FIG. 5 is a top view of a mat of side-by-side blocks cabled together.
Figure 6:
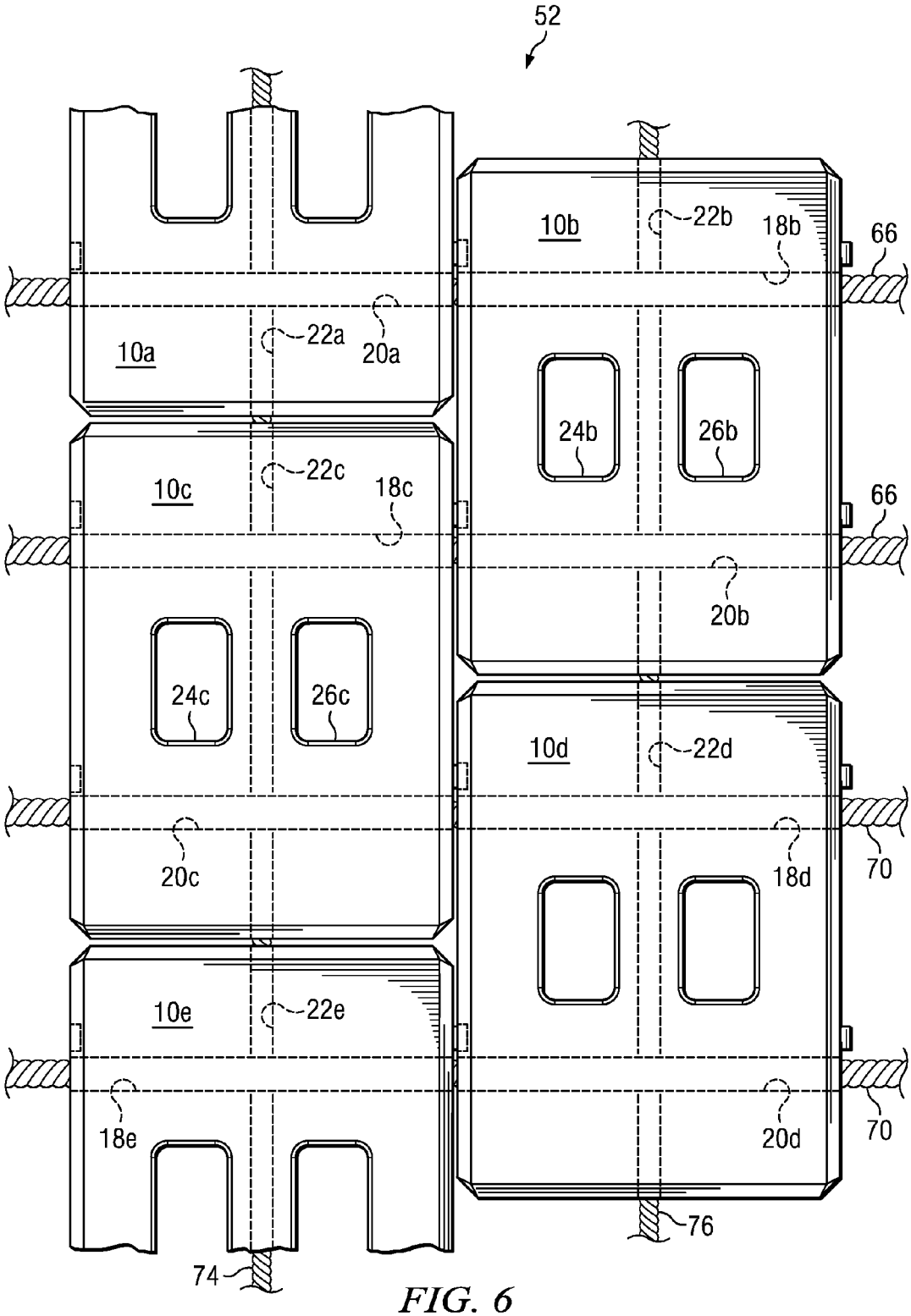
FIG. 6 is a top view of a mat of staggered blocks cabled together.

FIG. 5 illustrates a portion of a mat 50 configured with blocks 10 arranged side-by-side, and FIG. 6 illustrates a portion of a mat 52 of blocks 10 arranged in a staggered manner. With reference to FIG. 5, the blocks 10*a*-10*d* are arranged side-by-side in linear horizontal rows and vertical columns. It is understood that the portion of the mat 50 of erosion control blocks 10 is suspended from spaced-apart spreader bars (not shown) by the cables 54 and 58. Ropes or cables constructed of a synthetic material are generally employed so that the cables do not rust or otherwise deteriorate when subjected to water for long periods of time. The columns of blocks are tied together with the single lengths of individual cables 62 and 64. Moreover, for wide areas of erosion control coverage, the pigtail ends of the cables 62 and 64 of one mat are secured to the pigtail ends of a neighbor mat and fastened with crimped metal ferrules, or the like, to hold the neighbor mats together. The mats need be separated no more than an inch, or so, in order for a worker to grasp both pigtail ends, slip a ferrule over them and crimp the ferrule over both pigtail ends. This leaves very little space between neighbor mats so that the underlying soil is not subject to erosion by runoff water.

The cabling of the blocks 10 together using cables 54 and 58 is somewhat different. A single cable 54 is routed through the cable channel 18 of all the blocks in the row of the mat 50, reversed in a U-turn and routed the other direction through the cable channel 20 of all the blocks in the row of the mat 50. At the end of the mat 50 where the two ends of the cable 54 are exposed, a worker loops the ends and secures them together with a metal ferrule that is crimped to clamp the ends of the cable 54 together. In this manner, both ends of the row of blocks 10 has a cable loop. In practice, a mat 50 of blocks 10 is six blocks wide and thus has six cable loops at each end. The cable loops at one end of the mat 50 are hooked over respective hooks of a spreader bar, and the cable loops at the other end of the mat 50 are hooked over the respective hooks of the other spreader bar, whereupon the mat can be lifted by the spreader bars. The weight of the mat 50 suspended at opposite ends thereof by the spreader bars forms a catenary.

When neighbor mats 50 are installed by the crane in the area to be protected from erosion, the neighbor mats 50 are laid end to end so that the cable loops of one mat are adjacent the cable loops of the neighbor mat. The cable loops between the mats that are adjacent each other are then clamped together with metal ferrules, or other suitable clamping mechanisms. Again, the neighbor mats need be apart no further than an inch or so in order to allow a workman to grasp both of the cable loops, pull them up above the surface of the blocks, crimp them together, and then stuff them back down in the small space between the mat of neighbor blocks.

The guide ribs of the blocks 10*a* are engaged within the guide slots of the neighbor block 10*b* so that the respective cable channels 18*a* and 20*a* are aligned with the neighbor cable channels 18*b* and 20*b* of block 10*b*. Similarly, the neighbor blocks 10*c* and 10*d* are arranged side-by-side so as to be engaged via the guide slots and guide ribs, and the cable channels 18*c* and 20*c* of block 10*c* are aligned with respective cable channels 18*d* and 20*d* of neighbor block 10*d*. The blocks 10*a* and 10*b* are aligned linearly in a horizontal row, as are blocks 10*c* and 10*d*. The blocks 10*a* and 10*c* are aligned linearly in a column, as are blocks 10*b* and 10*d*. The blocks in the first column, namely blocks 10*a* and 10*c* are arranged so that the cable channels 22*a* and 22*c* are aligned. In like manner, the blocks 10*b* and 10*d* in the second column are arranged so that the cable channels 22*b* and 22*d* are aligned.

The row of engaged blocks 10*a* and 10*b* can be cabled together using the row cable 54 extended through both parallel cable channels of the blocks 10*a* and 10*b*. The second row of engaged blocks 10*c* and 10*d* can be cabled together using the row cable 58 extended through both parallel cable channels of the blocks 10*c* and 10*d*. The column of blocks 10*a* and 10*c* can be cabled together using column cable 62, and the second column of blocks 10*b* and 10*d* can be cabled together using column cable 64. Thus, the blocks 10-10*d* can be arranged in a mat side-by-side and cabled together in both the rows and columns of the mat 50. If desired, those skilled in the art may desire to either cable the blocks together in rows without cabling the columns, or vice versa. It can be appreciated that the blocks of each row remain registered in rows due to the engagement of the guide ribs 32 and 34 within the respective guide slots 36 and 38 of neighbor blocks.

FIG. 6 illustrates a portion of a mat 52 of staggered erosion control blocks 10*a*-10*e*. Importantly, the staggered mat 52 of blocks 10 can be configured with the same blocks 10 as described above in connection with the side-by-side mat 50 of FIG. 5. One guide rib of block 10*a* is engaged with a guide slot of the neighbor block 10*b*, and a guide rib of block 10*c* is engaged with the other guide slot of neighbor block 10*b*. Thus, block 10*b* is staggered or offset with respect to neighbor blocks 10*a* and 10*c*. The staggered nature of the blocks 10*a*-10*c* means that there is no linear row of side-by-side blocks, as there is in the mat 50 of FIG. 5. The staggered nature of the blocks of the mat 52 does not exclude the use of linear columns of blocks, as shown in FIG. 5. The cable channel 20*a* of block 10*a* is thus aligned with the cable channel 18*b* of block 10*b*. Similarly, the cable channel 18*c* of block 10*c* is aligned with the cable channel 20*b* of block 10*b*.

The block 10*c* has the other guide rib engaged with the guide slot of neighbor block 10*d*, and the block 10*e* has a guide rib engaged with the other guide slot of the neighbor block 10*d*. With this staggered arrangement of blocks, the cable channel 20*c* of block 10*c* is aligned with the cable channel 18*d* of block 10*d*. Similarly, the cable channel 18*e* of block 10*e* is aligned with the cable channel 20*d* of block 10*d*.

The mat 52 can be cable together by extending the row cable 66 through the cable channel 20*a* of block 10*a* and the aligned cable channel 18*b* of block 10*b*. The same cable 66 can be looped and returned to the mat 52 and threaded the other direction through cable channel 20*b* of block 10*b* and the aligned cable channel 18*c* of block 10*c*. The row cable 70 can be threaded through the cable channel 20*c* of block 10*c* and the aligned cable channel 18*d* of block 10*d*. The row cable 70 can be looped and returned to the mat 52 and threaded through the cable channel 20*d* of block 10*d* and the aligned cable channel 18*e* of block 10*e*.

Lastly, the column cable 74 can be threaded through the cable channel 22*a* of block 10*a*, the aligned cable channel 22*c* of block 10*c* and the aligned cable channel 22*e* of block 10*e*. The other column cable 76 can be threaded through the cable channel 22*b* of block 10*b* and the aligned cable channel 22*d* of block 10*d*. The looped ends of the cables 66 and 70 and the pigtail ends 74 and 76 of neighbor mats can be secured together in the same manner described above in connection with the mat 50 of FIG. 5.

An advantage of the staggered blocks of the mat 52 of FIG. 6 is that the vegetation holes of the blocks are also staggered. For example, the vegetation holes 24*b* and 26*b* of block 10*b* are staggered with respect to the vegetation holes 24*c* and 26*c* of block 10*c*. It is believed that with staggered vegetation holes in the mat 52 of blocks, there is an enhanced hydraulic friction to slow down the flow of water, and reduce the velocity of flowing water in the area to be protected from erosion.

In both of the mats 50 and 52 described above, the cables between the blocks 10 are embedded in the blocks and not exposed. In other words, the cables are extended through the body of the block without going through a vegetation hole, or the like. While there is a small space between the edge blocks of neighbor mats, the space is very short, and very little exposure of the cables exist.

Those skilled in the art may find that the block 10 can be fabricated with other features. For example, the blocks can be made with opposite end sides also having mating guide ribs and guide slots so that the columns of blocks can be engaged together, much like the rows of blocks described above. In addition, it is envisioned that specifications may exist or be required in the future where an area to be protected from erosion include mats of both the side-by-side configuration and staggered blocks. The mixing of the different configurations can be accommodated with the same type of block 10. In this instance, the opposite column edges of the staggered mat could have spacer blocks to make the edge linear to mate with the linear edge of the mat of side-by-side blocks. In addition, the guide ribs and guide slots can be constructed of other arrangements of male and female members.

From the foregoing, disclosed is a revetment block that can be engaged together and cabled as a mat in either a side-by-side arrangement, or in a staggered arrangement. The mat of either arrangement of blocks can be cabled together in either rows or columns, or both.

While the preferred and other embodiments of the invention have been disclosed with reference to a specific revetment block and associated mats, it is to be understood that many changes in detail may be made as a matter of engineering choices without departing from the spirit and scope of the invention, as defined by the appended claims.

What is claimed is:

1. A revetment block adapted for being cabled to one or more neighbor revetment blocks of similar construction, said revetment block comprising:

a body constructed of a heavy material;

the body of said revetment block having a bottom portion with substantially vertical side surfaces, and a top portion having inwardly beveled sides that facilitate articulation between neighbor revetment blocks;

a pair of cable channels extended through the body of said revetment block;

two spaced-apart guide slots formed in one side surface of the bottom portion of the body of said revetment block;

two spaced-apart guide ribs formed in an opposite side surface of the bottom portion of the body of said revetment block;

said two spaced-apart guide ribs are formed only in the bottom portion of the body of said revetment block so that there is reduced engagement of the guide ribs of one revetment block with the respective guide slots of the neighbor revetment block as the neighbor revetment block articulates in a direction where the respective beveled top portions of the revetment block and the neighbor revetment block become closer;

the two guide ribs of said revetment block adapted for being engaged in two respective guide slots of one said neighbor revetment block when configured in a side-by-side arrangement of revetment blocks of a first type mat, and the pair of cable channels of said revetment block align with the respective cable channels of the neighbor revetment block to form said first type mat; and one guide rib of said revetment block adapted for being engaged in a guide slot of one said neighbor revetment block and the other guide rib of said revetment block adapted for being engaged in a guide slot of another said neighbor revetment block when configured in a staggered arrangement of revetment blocks of a second type mat, and a first cable channel of the pair of cable channels of said revetment block aligned with one cable channel of said one neighbor revetment block and a second cable channel of the pair of cable channels of said revetment block aligned with one cable channel of said another neighbor revetment block to form said second type mat.

2. The revetment block of claim 1, further including a third cable channel formed through the body of said revetment block, said third cable channel formed orthogonal to said pair of cable channels.

3. The revetment block of claim 1, wherein said pair of cable channels are formed adjacent to an edge of articulation of said revetment block, the edge of articulation located where said revetment block articulates with respect to one or more said neighbor blocks when a mat of said revetment blocks are suspended by cables in a catenary.

4. The revetment block of claim 3, wherein said edge of articulation comprises a lateral edge of said revetment block that is located at an interface between the beveled top portion and the bottom portion of said revetment block.

5. The revetment block of claim 1, wherein one cable channel of the pair of cable channels is laterally offset from one guide rib of said pair of guide ribs, and the other cable channel of the pair of cable channels is laterally offset from the other guide rib of said pair of guide ribs.

6. The revetment block of claim 5, wherein one cable channel of the pair of cable channels is laterally offset from one guide slot of said pair of guide slots, and the other cable channel of the pair of cable channels is laterally offset from the other guide slot of said pair of guide slots.

7. The revetment block of claim 1, wherein each cable channel of said pair of cable channels is spaced apart the same distance as said pair of spaced-apart guide ribs.

8. The revetment block of claim 1, wherein each cable channel of said pair of cable channels is spaced apart the same distance as said pair of spaced-apart guide slots.

9. The revetment block of claim 1, wherein said revetment block has two opposite vertical sides surfaces with no guide ribs and no guide slots.

10. The revetment block of claim 1, wherein the top beveled portion of said revetment block joins the bottom portion of said revetment block at an edge of articulation, said cable channels open in opposite side surfaces of the body of said revetment block, said cable channel openings located at said edge of articulation so that cables extended through the respective cable channels of said revetment block and through the respective cable channels of a neighbor revetment block flex at said edge of articulation during articulation; and during increasing degrees of articulation between said revetment block and said neighbor revetment block the guide ribs of said revetment block are removed from engagement from the guide slots of said neighbor revetment block to thereby reduce frictional engagement between said revetment block and said neighbor revetment block to thereby facilitate large degrees of articulation.

11. A revetment block adapted for being cabled to one or more neighbor revetment blocks of similar construction, said revetment block comprising:

a body constructed with a heavy material;

said body having a top beveled portion and a bottom rectangular portion;

one or more vegetation holes extending from a top surface of the revetment block to a bottom surface of said revetment block;

a pair of parallel cable channels extended through the bottom rectangular portion of said revetment block, said pair of parallel cable channels not extending through said one or more vegetation holes;

a third cable channel extended through the bottom rectangular portion of said revetment block, but not through said one or more vegetation holes;

two spaced-apart guide slots formed in one vertical side surface of the bottom rectangular portion of said revetment block;

two spaced-apart guide ribs formed in an opposite vertical side surface of the bottom rectangular portion of said revetment block, but said two spaced-apart guide ribs do not extend on the top beveled portion to the top surface of said revetment block;

said revetment block having two opposite vertical side surfaces with no guide ribs and no guide slots; and the guide ribs of said revetment block adapted for being engaged in respective guide slots of one said neighbor revetment block when configured in a side-by-side arrangement of revetment blocks of a first type mat, and one guide rib of said revetment block adapted for being engaged in a guide slot of one said neighbor revetment block and the other guide rib of said revetment block adapted for being engaged in a guide slot of another said neighbor revetment block when configured in a staggered arrangement of revetment blocks of a second type mat.

12. The revetment block of claim 11, wherein said guide ribs do not extend at all onto the top beveled portion of the body of said revetment block.

13. The revetment block of claim 11, wherein said guide slots do not extend substantially into the top beveled portion of the body of said revetment block.

14. The revetment block of claim 11, further including a lateral edge where said top beveled portion joins said bottom rectangular portion of said revetment block, said lateral edge defines an edge of articulation about which said revetment block and one said neighbor revetment block articulate when suspended in a catenary.

15. The revetment block of claim 14, wherein at least one said cable channel is adjacent said edge of articulation.

16. The revetment block of claim 14, wherein said pair of cable channels have respective openings in a respective opposite side surfaces of said bottom rectangular portion, wherein respective edges of said cable channel openings touch said edge of articulation.

17. The revetment block of claim 14, further including a respective cable that extends through each said cable channel of said pair of cable channels, said respective cables touching said edge of articulation when said revetment block and said neighbor revetment block are suspended in a catenary.

18. A revetment block adapted for being cabled to one or more neighbor revetment blocks of similar construction, said revetment block comprising:

a body constructed of a heavy material, said body having a top beveled portion and a bottom portion;

a pair of cable channels extended through the body of said revetment block;

two spaced-apart guide slots formed in a side surface of the bottom portion of said revetment block;

two spaced-apart guide ribs formed in a side surface of only the bottom portion of said revetment block that is opposite the side surface in which said guide slots are formed, said spaced-apart guide ribs do not extend onto said top beveled portion of said revetment block;

said pair of cable channels spaced apart the same distance as said guide slots are spaced apart, and said pair of guide ribs are spaced apart the same distance as said guide slots are spaced apart, said cable channels do not extend through either said guide slots or extend through said guide ribs;

the top beveled portion of said revetment block joins the bottom portion of said revetment block at an edge of articulation so that a neighbor revetment block articulates with respect to said revetment block about said edge of articulation; and said pair of cable channels have respective openings in a surface of the body of said revetment block, and an edge of each said cable channel opening is adjacent said edge of articulation.

19. The revetment block of claim 18, wherein an edge of each said cable channel opening is less than one inch from said edge of articulation.

20. The revetment block of claim 18, wherein an edge of each said cable channel opening is less than one half inch from said edge of articulation.

* * * * *